US008152235B2

(12) United States Patent
McElmurry

(10) Patent No.: US 8,152,235 B2
(45) Date of Patent: Apr. 10, 2012

(54) METHOD OF UPHOLSTERING CHAIR ELEMENT

(75) Inventor: Terry J. McElmurry, Sylvania, OH (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 151 days.

(21) Appl. No.: 12/777,716

(22) Filed: May 11, 2010

(65) Prior Publication Data

US 2010/0289319 A1 Nov. 18, 2010

Related U.S. Application Data

(60) Provisional application No. 61/177,747, filed on May 13, 2009.

(51) Int. Cl.
*A47C 31/02* (2006.01)

(52) U.S. Cl. ..... 297/218.1; 297/218.3; 297/218.5; 248/345.1

(58) Field of Classification Search ..... 297/218.1, 297/218.3, 218.5; 248/345.1
See application file for complete search history.

(56) References Cited

U.S. PATENT DOCUMENTS

| | | | | |
|---|---|---|---|---|
| 1,463,293 | A | 7/1923 | Paddock | |
| 2,564,386 | A * | 8/1951 | Webb | 248/345.1 X |
| D200,702 | S | 3/1965 | Huret | |
| 3,707,276 | A | 12/1972 | Francis et al. | |
| 4,089,497 | A * | 5/1978 | Miller et al. | 248/345.1 |
| 4,106,739 | A * | 8/1978 | Gasser | 248/345.1 |
| 4,710,992 | A | 12/1987 | Falwell et al. | |
| 4,858,413 | A * | 8/1989 | Grushka | 108/27 |
| 5,118,162 | A * | 6/1992 | Saul | 248/345.1 X |
| 5,248,186 | A * | 9/1993 | Steinfeld et al. | 248/345.1 X |
| 5,271,662 | A * | 12/1993 | Saul | 248/345.1 X |
| 5,527,097 | A * | 6/1996 | Martin | 297/463.1 |
| D410,753 | S | 6/1999 | Davis | |
| D415,287 | S | 10/1999 | Davis | |
| D433,587 | S | 11/2000 | Barile | |
| 6,367,878 | B1 * | 4/2002 | Chung | 297/411.2 |
| D461,914 | S | 8/2002 | Hughes et al. | |
| 6,582,021 | B1 * | 6/2003 | Chung | 297/411.2 |
| 7,052,083 | B2 * | 5/2006 | Peitz et al. | 297/183.1 |
| D536,098 | S | 1/2007 | Walker | |
| D544,966 | S | 6/2007 | Seiling et al. | |
| D560,823 | S | 1/2008 | Holland | |
| D562,992 | S | 2/2008 | Szczekocki | |
| 7,438,360 | B2 | 10/2008 | Chung | |
| 7,455,364 | B1 * | 11/2008 | Lin et al. | 297/452.38 |
| 2005/0151409 | A1 | 7/2005 | Infanti et al. | |

* cited by examiner

*Primary Examiner* — Rodney B White
(74) *Attorney, Agent, or Firm* — Gifford, Krass, Sprinkle, Anderson & Citkowski, P.C.; Douglas L. Wathen

(57) ABSTRACT

An elongated edging is provided for use in a method of upholstering a chair element with a perimeter edge. The edging has a pair of sides and a top portion, with a slot defined between the sides for receiving the perimeter edge of the chair element. A flange extends outwardly from the outward face of the side of the edging and defines a recess between an upper side of the flange and the outward face of the side of the edging. A portion of upholstery is attached to the chair element using fasteners which are positioned in the recess.

12 Claims, 5 Drawing Sheets

METHOD OF UPHOLSTERING CHAIR ELEMENT

REFERENCE TO RELATED APPLICATIONS

This utility patent application claims priority from U.S. provisional patent application Ser. No. 61/177,747, filed May 13, 2009, the entire content of which is incorporated herein by reference.

FIELD OF THE INVENTION

The present invention relates generally to methods for upholstering chairs.

BACKGROUND OF THE INVENTION

Many types of furniture are upholstered, or covered with fabric and/or padding, to improve the aesthetics and comfort of the furniture. Certain types of furniture, such as the chairs typically used in restaurants and convention halls, include a board or a rigid element, such as a chair back, with a layer of foam and fabric attached to one or more sides. One typical design also includes an extruded piece of resilient edging that covers the perimeter edge of the chair back so as to provide a rounded resilient edge for the chair back. The front and/or back of the chair back is upholstered with the upholstery partially covering the edging. The upholstery is attached such that it covers the front and/or rear face of the rigid element or board with the edging defining the perimeter edge.

Various approaches are used for upholstery of such a chair. FIG. 4 shows one approach in which a chair element, such as a rigid board 10, has resilient edging 12 attached to the perimeter edge of the board 10. The resilient edging 12 has sides 14 that extend downwardly onto the face of the board and are attached thereto with a fastener, such as staple 16. A rigid element, such a piece of hardboard 18, has an overall shape similar to, but slightly smaller than, the board 10. A layer of foam 20 and upholstery material 22 is attached to the hardboard 18. A piece of welt 24 is typically attached to the edge of the upholstery material 22. The hardboard 18 is attached to the board 10, such as by using Christmas tree style fasteners 26 engaging holes 28, to interconnect the upholstered hardboard to the board 10. This results in upholstery covering one or both sides of the chair element, thereby resulting in an upholstered chair element, such as a chair back. This approach to upholstery provides a pleasing aesthetic appearance but may be labor and/or material intensive.

Another approach is shown in FIG. 5. This approach is similar to the approach shown in FIG. 4 in that a piece of resilient edging 12 is received on the edge of a board 10 and connected thereto. However, in this approach, the upholstery is connected directly to the board 10 rather than being first connected to a support element such as hardboard 18. As shown, a layer of foam 20 is covered with upholstery material 22 with a welt 24 attached thereto. The upholstery material 22 and foam 20 are then connected to the board 10 using a fastener, such as staple 27. The staple 27 is passed through the upholstery material 22 adjacent the welt 24 and penetrates a side 14 of the edging 12 so as to engage the board 10 and retain the upholstery material 22 and foam layer 20 in place. This approach eliminates the need for the hardboard 18 shown in FIG. 4, but requires precise placement of the staples 27 and upholstery layer 22. It also tends to compress the foam layer adjacent the edge, which may be aesthetically undesirable.

SUMMARY OF THE INVENTION

The present invention provides a method for upholstering a chair element, such as a chair back, with a perimeter edge. An elongated edging is provided that has a pair of sides and a top portion extending between and interconnecting the sides. A slot is defined between the sides for receiving the perimeter edge of the chair element. The sides of the edging each have outward faces with a flange extending outwardly therefrom. Each flange extends longitudinally along the elongated edging. A recess is defined between an upper side of each flange and the outward face of the side of the edging. The edging is disposed on the perimeter edge of the chair element such that the perimeter edge is disposed in the slot. A portion of upholstery is provided with a perimeter edge. An edge welt defines the perimeter edge. The upholstery is attached to the chair element by installing a fastener through the upholstery, through the side of the edging and into the chair element. The fastener extends through the upholstery immediately inboard of the edge welt and extends through the side of the edging such that the fastener is generally disposed in the recess between the flange and the side of the edging.

DETAILED DESCRIPTION OF THE PREFERRED EMBODIMENTS

The present invention provides an improved upholstery method for upholstering elements such as a chair back. The present invention provides an edging that is disposed on a perimeter edge of the chair element. The edging has a flange that extends outwardly from its side and defines a recess between the flange and the outer face of the side of the edging. Upholstery is then attached by passing a fastener through the upholstery near its edge, through the side of the edging and into the chair element. The fastener is positioned such that it is disposed in the recess between the flange and the outer face of the side of the edging. This serves to hide the fastener, provide a cleanly finished edge and helps to provide a pleasingly shaped edge to the upholstered chair element.

Figure 1:
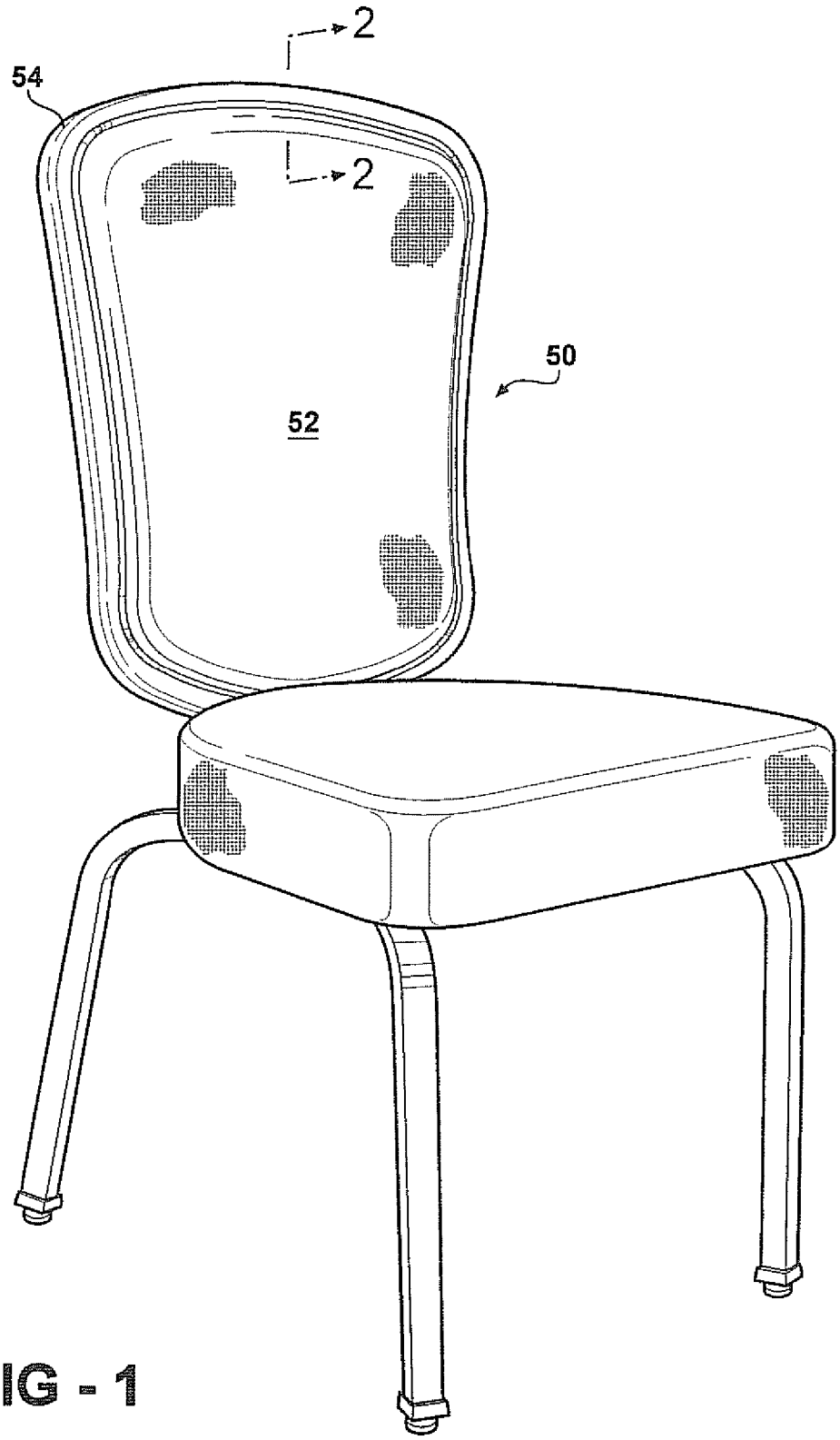
FIG. 1 is a perspective view of a chair that is upholstered using a method according to the present invention.

Referring to FIG. 1, a chair 50 has a chair back 52 with a perimeter edge 54. In this embodiment, the perimeter edge 54 is defined by an elongated piece of resilient edging, while the front and back faces of the chair back 52 are upholstered with the upholstery material covering a layer of foam. The perimeter edge of the upholstery material is defined by a welt.

Figure 2:
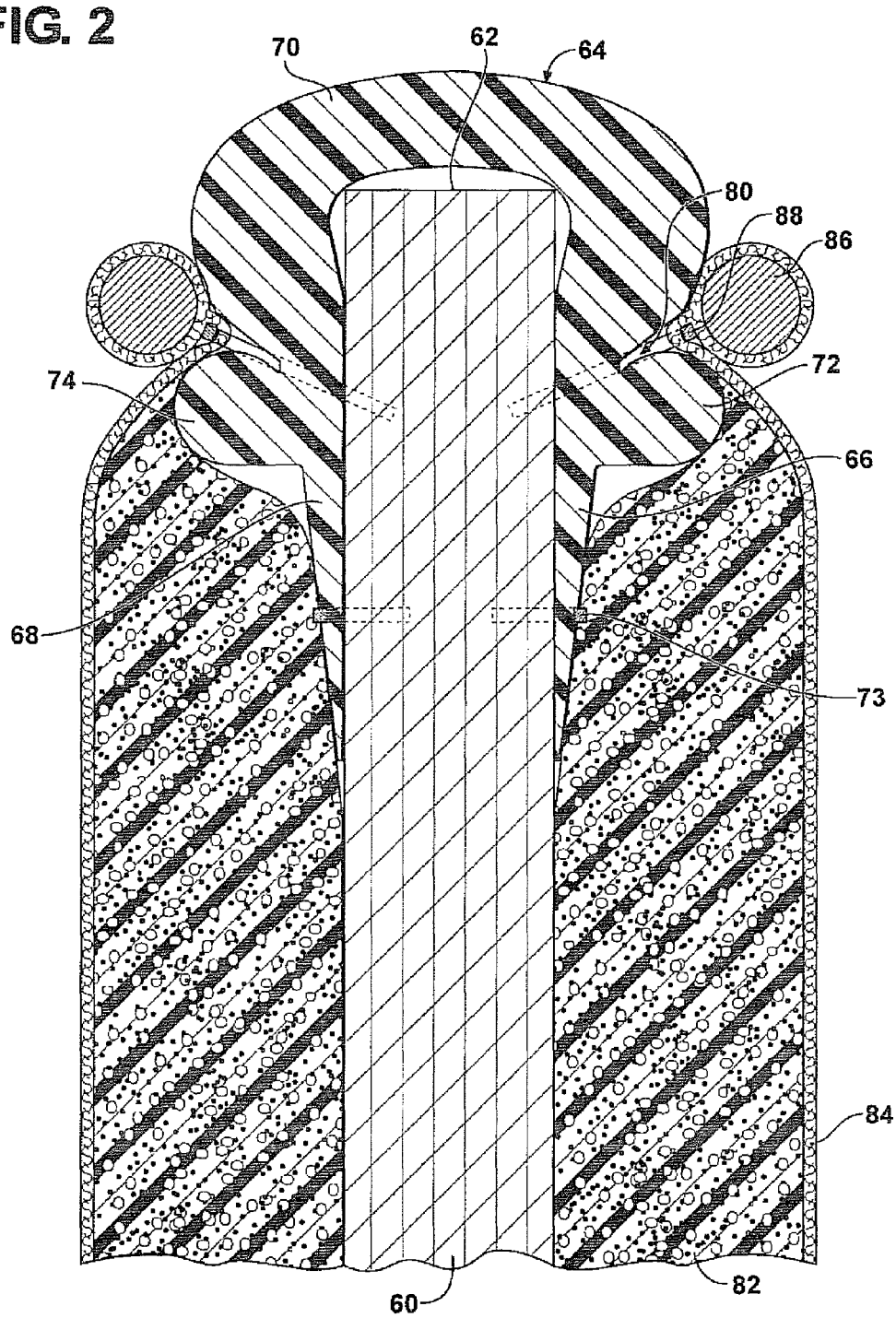
FIG. 2 is a cross-sectional view, taken along lines 2-2 of FIG. 1, of a portion of the chair back showing the details of the upholstery method.

FIG. 2 shows a cross-sectional view of the chair back 52 of FIG. 1, taken along lines 2-2. The chair back has a board 60 defining the core or structure of the chair back. This board 60 may be a wooden board or may be formed of other materials. The board 60, which may be referred to herein as a chair element, has a perimeter edge 62. The present invention provides an elongated edging 64 that has a pair of sides 66 and 68 and a top portion 70 that extends between and interconnects the sides. As shown, a slot is defined between the sides 66 and 68 for receiving the perimeter edge 62 of the board 60. In the illustrated embodiment, the edging 64 has a generally bulbous shaped top portion 70. The illustrated edging has a pair of flanges 72 and 74 that each extend outwardly from an outer face of the sides 66 and 68, respectively.

Figure 3:
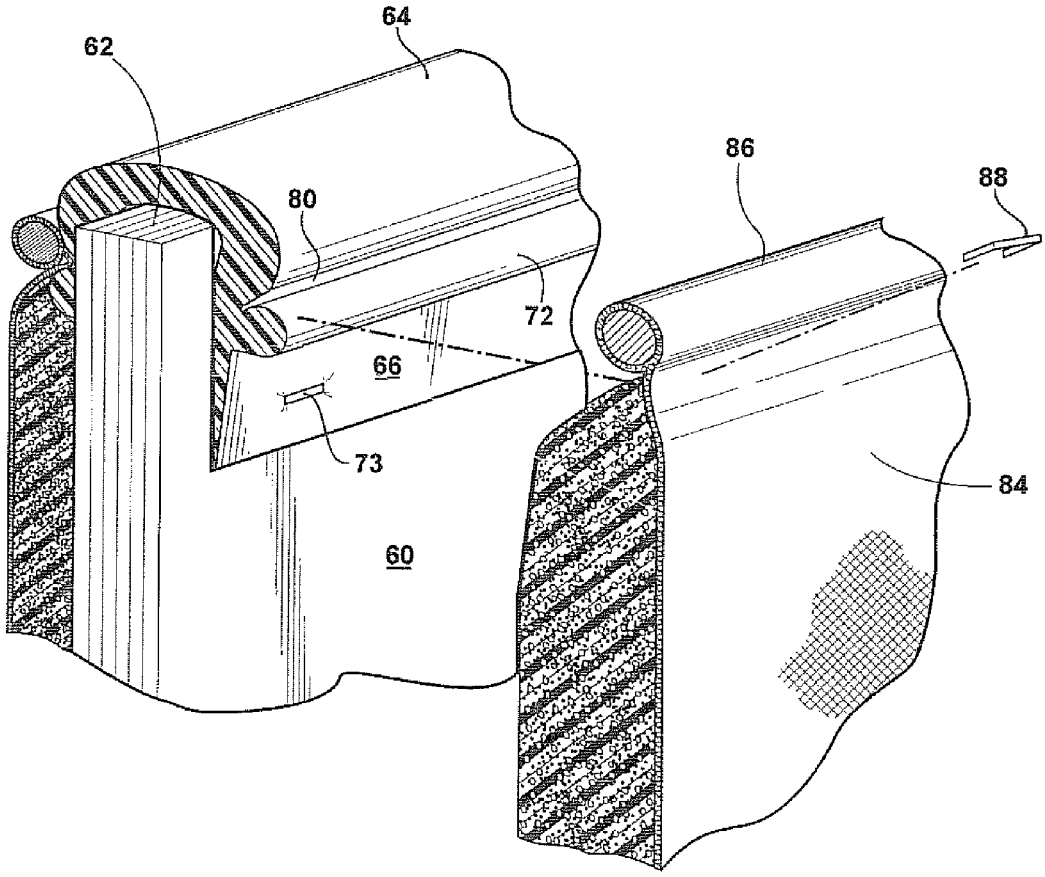
FIG. 3 is an exploded perspective view of a portion of the edge of the chair back further illustrating the method of the present invention.
Figure 4:
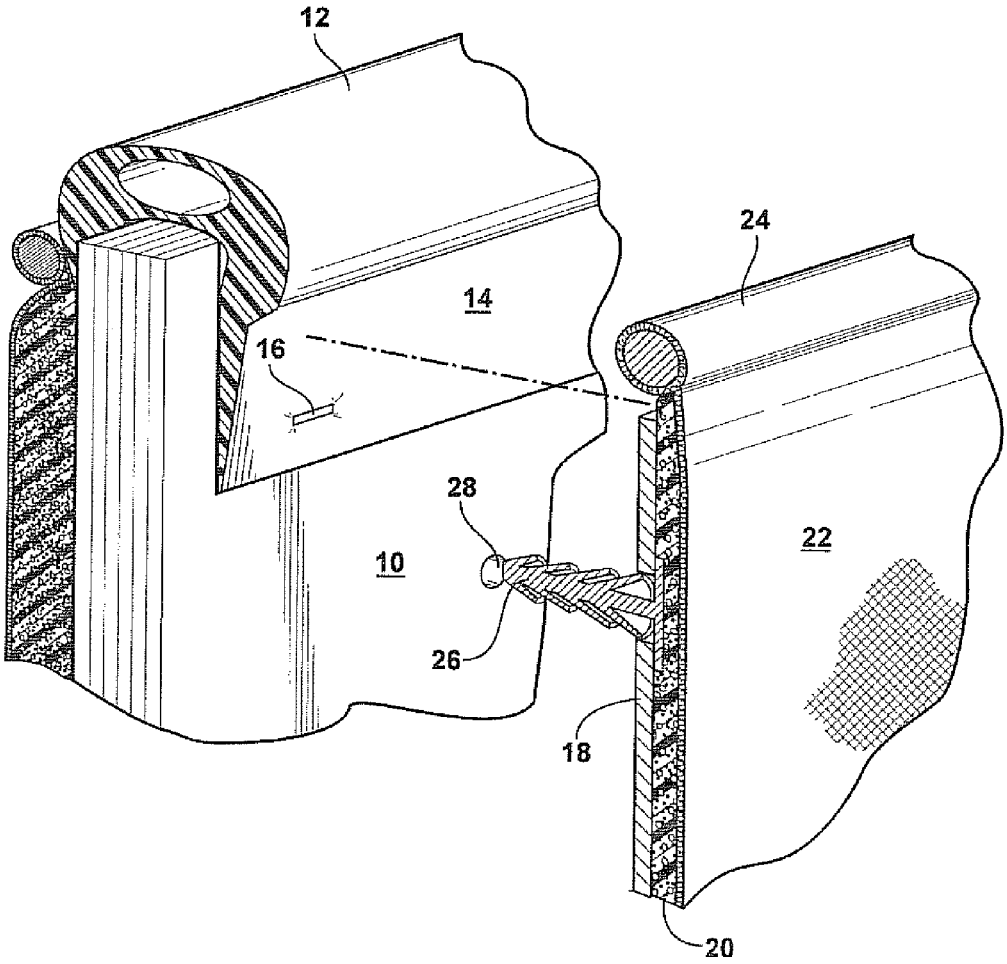
FIG. 4 Prior Art
FIG. 4 is an exploded perspective view of a portion of an edge of a chair back showing a prior art method of upholstery.
Figure 5:
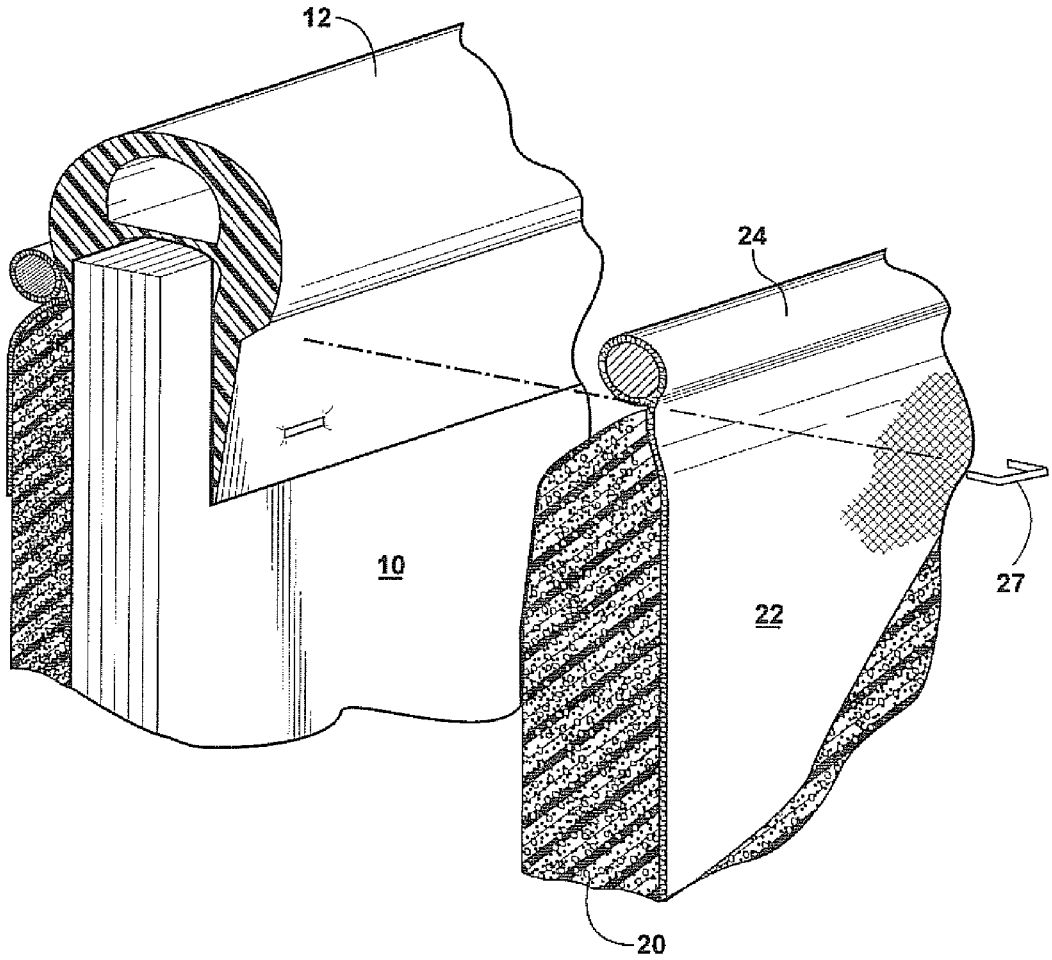
FIG. 5 Prior Art
FIG. 5 is an exploded perspective view of a portion of an edge of a chair back showing another prior art approach to upholstery.

FIG. 3 shows the same elements shown in FIG. 2, but with the upholstery removed from one side of the board 60. As shown, the flange 72 extends longitudinally along the elongated edging 64. A narrow recess 80 is defined between the upper side of each flange and the outward face of the side of the edging. Alternatively, the recess may be described as being defined between the upper surface of the flange and the bulbous outer surface of the top portion 70. In the illustrated embodiment, flanges 72 are also bulbous shaped but are significantly smaller, and have a smaller radius, than the bulbous top portion 70.

In use, the edging 64 is disposed on the perimeter edge 62 of the chair element 60 such that the perimeter edge 62 is received between the sides 66 and 68. The edging 64 may be attached to the chair element 60, such as by using fasteners 73. Upholstery is then attached to the chair element 60 and edging 64. In the illustrated embodiment, the upholstery includes a layer of foam 82 covered by a layer of upholstery material 84. The foam and upholstery material may be connected to one another with an adhesive. The upholstery material 84 has a perimeter edge defined by an edge welt 86. The upholstery 84 is interconnected with the chair element 60 by passing a fastener, such as staple 88, through the upholstery material 84 adjacent the edge welt 86 and through the side 66 of the edging 64 so as to engage the chair element 60. The fastener 88 is positioned such that it is disposed at least partially in the recess 80 between the flange 72 and the upper portion 70 of the edging 64. As will be clear to those of skill in the art, this approach provides several advantages. First, the recess 80 helps to hide the fastener 88. Second, the recess 80 and the flange 72 provide a reference for the upholsterer positioning the fasteners such that the fasteners are reliably positioned in a correct location. Third, the flange 72 helps support the upholstery material 84 away from the face of the board 60, thereby providing a thicker appearance to the upholstery. Some embodiments of the present invention may provide all of these advantages while others may provide fewer.

While it is typical that a chair element, such as a chair back, is upholstered on both sides, the present invention may also be used in applications where only a single side is upholstered. In this case, the edging 64 may include only a single flange instead of two flanges, if desired.

In addition to the method as described herein, the present invention also covers the elongated edging in combination with a chair back.

As will be clear to those of skill in the art, the herein described embodiments of the present invention may be altered in various ways without departing from the scope or teaching of the present invention. It is the following claims, including all equivalents, that define the scope of the present invention.

The invention claimed is:

1. A method of upholstering a chair element having a perimeter edge, comprising:

providing an elongated edging having a pair of sides and a top portion extending between and interconnecting the sides, a slot being defined between the sides for receiving the perimeter edge of the chair element, the sides of the edging having outward faces each having a flange extending outwardly therefrom, each flange extending longitudinally along the elongated edging, a recess being defined between an upper side of each flange and the respective outward face of the side of the edging;

disposing the edging on the perimeter edge of the chair element such that the perimeter edge is disposed in the slot;

providing a portion of upholstery having a perimeter edge, the upholstery having a edge welt defining the perimeter edge; and attaching the upholstery to the chair element by installing a fastener through the upholstery, through the side of the edging and into the chair element, the fastener extending through the upholstery immediately inboard of the edge welt, the fastener extending through the side of the edging such that the fastener is generally disposed in the recess between one of the flanges and the side of the edging.

2. The method of claim 1, wherein the top portion of the elongated edging is generally bulbous.

3. The method of claim 2, wherein the flanges are each generally bulbous.

4. The method of claim 1, wherein the fastener is a staple.

5. The method of claim 1, wherein:

the portion of upholstery is a first portion and the first portion is attached to a first face of the chair element;

the method further comprising:

providing a second portion of upholstery having a perimeter edge, the upholstery having an edge welt defining the perimeter edge; and attaching the second portion of upholstery to a second face of the chair element that is opposite the first face by installing a fastener through the upholstery, through the side of the edging and into the chair element, the fastener extending through the upholstery immediately inboard of the edge welt, the fastener extending through the side of the edging such that the fastener is generally disposed in the recess between the other flange and the side of the edging.

6. The method of claim 1, further comprising:

attaching the edging to the chair element prior to attaching the upholstery to the chair element.

7. A method of upholstering a chair element having a perimeter edge, comprising:

providing an elongated edging having a pair of sides and a top portion extending between and interconnecting the sides, a slot being defined between the sides for receiving the perimeter edge of the chair element, the sides of the edging having outward faces, a flange extending outwardly from at least one of the sides, the flange extending longitudinally along the elongated edging, a recess being defined between an upper side of the flange and the outward face of the side of the edging;

disposing the edging on the perimeter edge of the chair element such that the perimeter edge is disposed in the slot;

providing a portion of upholstery having a perimeter edge, the upholstery having a edge welt defining the perimeter edge; and attaching the upholstery to the chair element by installing a fastener through the upholstery, through the side of the edging and into the chair element, the fastener extending through the upholstery immediately inboard of the edge welt, the fastener extending through the side of the edging such that the fastener is generally disposed in the recess between the flange and the side of the edging.

8. In combination, a chair back and an elongated edging, comprising:

a chair back having a perimeter edge;

an elongated edging having a pair of sides and a top portion extending between and interconnecting the sides, a slot being defined between the sides of the edging, the sides of the edging having outward faces each having a flange extending outwardly therefrom, each flange extending longitudinally along the elongated edging, a recess being defined between an upper side of each flange and the outward face of the side of the edging;

wherein the elongated edging is disposed along the perimeter edge of the chair back with the perimeter edge being disposed in the slot defined between the sides;

a portion of upholstery having a perimeter edge, the upholstery having a edge welt defining the perimeter edge; and a plurality of fasteners;

wherein the portion of upholstery is attached to the chair back by the plurality of fasteners such that each of the fasteners extends through the upholstery, through the side of the edging and into the chair element, the fasteners extending through the upholstery immediately inboard of the edge welt, the fasteners extending through the side of the edging such that the fasteners are generally disposed in the recess between one of the flanges and the side of the edging.

9. The method of claim 8, wherein the top portion of the elongated edging is generally bulbous.

10. The method of claim 9, wherein the flanges are each generally bulbous.

11. The method of claim 8, wherein the fasteners are staples.

12. In combination, a chair back and an elongated edging, comprising:

a chair back having a perimeter edge;

an elongated edging having a pair of sides and a top portion extending between and interconnecting the sides, a slot being defined between the sides of the edging, the sides of the edging having outward faces, a flange extending outwardly from at least one of the sides, the flange extending longitudinally along the elongated edging, a recess being defined between an upper side of the flange and the outward face of the side of the edging;

wherein the elongated edging is disposed along the perimeter edge of the chair back with the perimeter edge being disposed in the slot defined between the sides;

a portion of upholstery having a perimeter edge, the upholstery having a edge welt defining the perimeter edge; and a plurality of fasteners;

wherein the portion of upholstery is attached to the chair back by the plurality of fasteners such that each of the fasteners extends through the upholstery, through the side of the edging and into the chair element, the fasteners extending through the upholstery immediately inboard of the edge welt, the fasteners extending through the side of the edging such that the fasteners are generally disposed in the recess between the flange and the side of the edging.

* * * * *